United States Patent [19]

Forberg et al.

[11] 3,958,981

[45] May 25, 1976

[54] PROCESS FOR DEGASSING ALUMINUM AND ALUMINUM ALLOYS

[75] Inventors: Helge O. Forberg, Owensboro, Ky.; Henry E. Chia, Carrollton; Paul S. Keith, Atlanta, both of Ga.

[73] Assignees: Southwire Company, Carrollton, Ga.; National Steel Corporation, Pittsburgh, Pa.

[22] Filed: Apr. 16, 1975

[21] Appl. No.: 568,810

[52] U.S. Cl. ..... 75/68 R; 75/93 E

[51] Int. Cl.[2] ..... C22B 21/06

[58] Field of Search ..... 75/68 R, 93 E, 93 R, 75/93 AC

[56] References Cited

UNITED STATES PATENTS 2,528,208 10/1950 Bonsack et al. ..... 75/68 R 3,149,960 9/1964 Robinson, Jr. ..... 75/68 R

*Primary Examiner*—M. J. Andrews

*Attorney, Agent, or Firm*—Van C. Wilks; Herbert M. Hanegan; Stanley L. Tate

[57] ABSTRACT

The process for degassing aluminum and aluminum alloys comprising treating the molten metal with a gaseous mixture consisting essentially of fluorine, hydrofluoric acid, carbon monoxide and carbon dioxide. Fluorine, hydrofluoric acid, carbon monoxide and carbon dioxide are produced during the electrolytic reduction of alumina to form aluminum, therefore, the gaseous mixture resulting from this electrolytic reduction may be used to degas aluminum and aluminum alloys.

13 Claims, No Drawings

PROCESS FOR DEGASSING ALUMINUM AND ALUMINUM ALLOYS

BACKGROUND OF THE INVENTION

This invention relates to a method of purifying aluminum and more particularly to the degassing of aluminum and aluminum alloys by passing a gaseous mixture of fluorine, hydrofluoric acid, carbon monoxide and carbon dioxide through the molten metal.

The aluminum metal in commercial use derives from two possible sources: it is either virgin aluminum derived from alumina, known as primary aluminum, or metal obtained by scrap recovery from many sources, known as secondary aluminum.

In both cases the metal has to be refined before it can be used for fabrication purposes. Oxides form dross and hydrogen dissolves in the metal, its solubility increasing with temperature. Unless removed, this dissolved gas causes flaws in the final cast products upon cooling. Another major problem is impurity elements which must either be completely removed from the molten metal or at least removed to a very low predetermined level.

It has been common practice in the aluminum and aluminum alloys industry to pass chlorine through molten metal in order to remove dissolved gasses and further to free the metal from porosity, oxide inclusions and other impurities. This process, known as fluxing or degassing, generally employs chlorine gas in full strength, i.e., 100 percent concentration. It has also been proposed to utilize nitrogen gas for degasification of aluminum. U.S. Pat. No. 3,149,960, discloses a fluxing gas containing a mixture of chlorine and carbon monoxide.

The process of contacting aluminum with a reactive chlorine-contained vapor is generally referred to as "chloridizing" aluminum. By this process, impurity metals and hydrogen are removed. Magnesium and sodium are converted to their chlorides and thus can be removed from the surface of the molten metal as a dross.

Generally, the treatment of aluminum is carried out by bubbling the chlorine gas into the molten metal while held in a melting or holding furnace or in a ladle. Chemical reaction between molten metal and chlorine insues, and chlorides are formed which rise to the surface of the metal as a dross, consisting of metallic chlorides, trapped particles of aluminum, and aluminum oxides. One disadvantage of this process is that the efficiency of the chlorine utilization is low. Further, during treatment, appreciable quantities of aluminum are lost from the molten bath as aluminum chloride. The excess chlorine which has to be used results in two problems. A part of the chlorine is lost as aluminum chloride. This hydrolyses on contact with atmospheric water to produce hydrochloric acid and a fume of extremely finely divided aluminum hydroxide or oxide. These two together constitute a formidable air pollution problem. Although the acid can be fairly effectively removed by a suitable water scrubbing system in the gas offtake, the alumina dust is so small, below 2 microns, that its removal is extremely difficult. Secondly, gaseous chlorine is lost from the melt and this can only be removed from the stack gasses by some form of reactive system. By the present invention not only are the problems and expense associated with the use of chlorine avoided, but a gaseous mixture currently regarded as waste in the production of aluminum by the electrolytic reduction of alumina is utilized. Presently the stack gas from the potlines of an aluminum electrolytic reduction plant not only are regarded as waste, but present air pollution control problems. The potline exhaust fumes must be scrubbed and cleaned by an elaborate system before these exhaust gases can be released into the atmosphere.

It is therefore an object of this invention to provide an improved method of degassing aluminum.

It is a further object of the present invention to provide a novel process of degassing aluminum using a gaseous mixture produced by the electrolytic reduction of alumina to aluminum.

Further objects and advantages of the present invention will become apparent from the following description.

DESCRIPTION OF THE PREFERRED EMBODIMENT

This invention is concerned with the process of degassing aluminum and aluminum alloys by passing through the molten aluminum or aluminum alloy, a gaseous mixture consisting essentially of fluorine, hydrofluoric acid, carbon monoxide and carbon dioxide. Advantageously, the gaseous mixture contains from about 0.1 to about 12.0 percent by volume fluorine, from about 0.5 to about 5.0 percent by volume hydrofluoric acid, from about 0.3 to about 10.0 percent by volume carbon monoxide, and from about 30.0 to about 80.0 percent by volume carbon dioxide. Preferably, the gaseous mixture contains from about 1.0 to about 9.0 percent by volume fluorine, from about 0.8 to about 3.0 percent by volume hydrofluoric acid, from about 0.5 to about 8.0 percent by volume carbon monoxide, and from about 50.0 to about 80.0 percent by volume carbon dioxide.

In accordance with this invention, molten aluminum or aluminum alloys are treated by bubbling through the molten metal either (a) a gaseous mixture of fluorine, hydrofluoric acid, carbon monoxide and carbon dioxide, or (b) a gaseous mixture of fluorine, hydrofluoric acid, carbon monoxide, carbon dioxide and a diluent gas. The use of a diluent gas is a matter of choice for convenience and does not materially influence the results.

In accordance with another aspect of this invention, molten aluminum or aluminum alloys are treated by means of a gaseous mixture of fluorine, hydrofluoric acid, carbon monoxide and carbon dioxide, with or without the addition of a diluent gas in the presence of a material capable of liberating carbon monoxide under the conditions of treatment. Thus, there may be used in combination with the gaseous mixture, solid fluxes which are capable of releasing carbon monoxide in contact with the hot molten aluminum bath. Therefore, additional carbon monoxide in this aspect of the invention is supplied by a material which is capable of generating or liberating carbon monoxide under fluxing conditions. Thus, if the gaseous mixture is supplied to the molten aluminum through a carbon (graphite) tube at the high temperature of molten aluminum, the carbon dioxide is at least partially reduced to carbon monoxide, under contact with the hot carbon of the tube.

In accordance with this invention, the ratio of the individual gases present in the gaseous mixture is subject to a wide degree of variation, and suitable results can be obtained with mixtures containing as little as 0.1 percent by volume fluorine, 0.5 percent by volume hydrofluoric acid. 0.3 percent by volume carbon monoxide, and 30.0 percent by volume carbon dioxide. In instances where the minimum amount of one or more gases of the gaseous mixture is used, the remaining gases may be present at any percent by volume up to the maximum percent by volume discussed below, taking into consideration that the percent by volume of the four gases must not exceed 100 percent. Suitable results can also be obtained with mixtures containing as much as 12.0 percent by volume fluorine, 5.0 percent by volume hydrofluoric acid, 10.0 percent by volume carbon monoxide, and 80.0 percent by volume carbon dioxide. Again, it being understood that where the maximum percent of one or more of the gases is present, the other gases may be present within their minimum to maximum range of percent by volume as long as the total percent by volume of the four gases does not exceed 100 percent.

The stack gas from potlines of an aluminum electrolytic reduction plant usually contains a gaseous mixture of fluorine, hydrofluoric acid, carbon monoxide and carbon dioxide. In those instances where the stack gas also contains a large amount of particles, these particles should be removed prior to using the gaseous mixture to degas aluminum and aluminum alloys. The volume percent of the constituents in the gaseous mixture depends upon the raw materials used in the potlines and the operating conditions of the potlines, therefore, if the gaseous mixture from the potlines does not contain the volume percent of constituents which is within the ranges stated above for the minimum and maximum volume percent for each constituent, then fluorine, hydrofluoric acid, carbon monoxide or carbon dioxide should be added to the gaseous mixture to insure that the volume percent of each constituent in the gaseous mixture falls within the minimum and maximum volume percent stated above.

The treatment temperature of the metal is between its melting and vaporization points, and ordinarily lies in the range of about 1300° to about 1500°F, but this temperature is not critical. The gaseous mixture may be supplied to the molten metal through a carbon (graphite) or an iron fluxing tube.

If a diluent gas is desired to be used, the gas may be nitrogen, air, or the like. Advantageously, the diluent gas used is nitrogen. The volume percentages and ratios of the gaseous mixture mentioned above applies whether or not a diluent gas is used. i.e., the ratio or volume percent of individual gases within the gaseous mixture is in the same proportion whether or not a diluent gas is used. Advantageously, the ratio of gaseous mixture to diluent gas is from about 9:1 to about 1:9.

The process of the present invention generally will be applicable prior to casting, but is not limited thereto since it may be used wherever aluminum is remelted. In accordance with this invention, the rate of gas flow feed may be adjusted to any desired value, depending upon the type of treating apparatus employed, the melting temperature of the metal being fluxed, size of the fluxing tube, and the like. The process of this invention may be carried in any suitable and convenient apparatus customarily used for this purpose, such as a melting furnace of the reverberatory or open hearth type fitted with one or more graphite or iron tubes for introducing the gaseous treating mixture.

The process of the treatment may be measured by a standard vacuum gas test, in accordance with which a sample of molten metal is placed in a chamber under a given degree of vacuum, for example, 50 mm. mercury, and allowed to solidify, expanding the gas bubbles. The sample is then weighed and its density (grams per cc) measured in order to ascertain how closely it approaches the theoretical density of the alloy or pure metal. The density may be plotted against the fluxing time, the slope of the resulting curve furnishing an indication of the speed of degassing of the metal.

EXAMPLE

A laboratory furnace was charged with 10 pounds of 99.90 percent purity aluminum, the temperature of the bath was maintained between 1300° and 1350°F. A gaseous mixture of 4.5 percent by volume fluorine, 2.0 percent by volume hydrofluoric acid, 4.0 percent by volume carbon monoxide, and 50.0 percent by volume carbon dioxide, obtained from the exhaust fumes of an electrolytic aluminum reduction plant, with 39.5 percent by volume nitrogen added as a diluent gas, was fed into the molten metal through an iron tube ½ inch O.D., and 15 inches long, entering the melt at approximately a 45° angle, to a depth of approximately 4 inches. The treating gas was passed in at a rate of 2 cubic feet per hour and duplicate samples taken for density tests at 10 minute intervals until visual observation indicated that the gassification was complete or until no further substantial increase in density of the metal was noted. Comparative results using 100% chlorine are as follows: (a) 100% chlorine:

| Indicated Density, g/cc | Time (mins.) |
|---|---|
| 2.2 | 0 |
| 2.35 | 10 |
| 2.50 | 20 |
| 2.70 | 30 |

Therefore, 30 minutes were required to achieve an indicated density of 2.70. (b) the gaseous mixture:

| Indicated Density, g/cc | Time (mins.) |
|---|---|
| 2.2 | 0 |
| 2.40 | 10 |
| 2.59 | 20 |
| 2.71 | 30 |

Therefore, a good density was achieved in 30 minutes.

This invention has been described in detail with particular reference to the preferred embodiments thereof, it should be understood that variations and modifications can be effected within the spirit and scope of the invention as described hereinbefore and as defined in the appended claims.

What is claimed is:

1. A process for degassing aluminum and aluminum alloys which comprises passing through the molten metal a gaseous mixture consisting essentially of fluorine, hydrofluoric acid, carbon monoxide and carbon dioxide.

2. The process of claim 1 wherein the gaseous mixture contains from about 0.1 to about 12.0 percent by volume fluorine, from about 0.5 to about 5.0 percent by volume hydrofluoric acid, from about 0.3 to about 10.0 percent by volume carbon monoxide and from about 30.0 to about 80.0 percent by volume carbon dioxide.

3. The process of claim 1 wherein said gaseous mixture is obtained from the production of aluminum by electrolytic reduction of alumina.

4. The process according to claim 1 including a diluent gas in combination with the gaseous mixture.

5. The process according to claim 4 wherein the ratio of gaseous mixture to diluent gas is from about 9:1 to about 1:9.

6. The process according to claim 4 wherein the diluent gas is nitrogen.

7. A process for degassing molten aluminum and aluminum alloys comprising the steps:

recovering a gaseous mixture effluent from an electrolytic aluminum reduction operation, said gaseous mixture comprising, in combination, fluorine, hydrofluoric acid, carbon monoxide and carbon dioxide; and passing said recovered gaseous mixture through said molten aluminum for a time and in an amount necessary to effect degassing of said melt.

8. The processs of claim 7 wherein the gas mixture utilized is passed through carbon to form carbon oxide.

9. The process of claim 7 wherein the gaseous mixture contains from about 0.1 to about 12.0 percent by volume fluorine, from about 0.5 to about 5.0 percent by volume hydrofluoric acid, from about 0.3 to about 10.0 percent by volume carbon monoxide and from about 30.0 to about 80.0 percent by volume carbon dioxide.

10. The process of claim 9 wherein said recovered gaseous mixture effluent is first treated to remove solid particles and then adjusted to obtain a predetermined ratio of said gases therein.

11. The process according to claim 7 including a diluent gas in combination with the gaseous mixture.

12. The process according to claim 11 wherein the ratio of gaseous mixture to the diluent gas is from about 9:1 to about 1:9.

13. The process according to claim 11 wherein the diluent gas is nitrogen.

* * * * *